US006607577B2

(12) United States Patent
Vaculik et al.

(10) Patent No.: US 6,607,577 B2
(45) Date of Patent: Aug. 19, 2003

(54) DESULPHURIZATION REAGENT CONTROL METHOD AND SYSTEM

(75) Inventors: Vit Vaculik, Hamilton (CA); Shannon L. Quinn, Hamilton (CA); Michael S. Dudzic, Ancaster (CA)

(73) Assignee: Dofasco Inc., Hamilton (CA)

( * ) Notice: Subject to any disclaimer, the term of this patent is extended or adjusted under 35 U.S.C. 154(b) by 0 days.

(21) Appl. No.: 09/927,394

(22) Filed: Aug. 13, 2001

(65) Prior Publication Data

US 2002/0038926 A1 Apr. 4, 2002

Related U.S. Application Data

(60) Provisional application No. 60/224,344, filed on Aug. 11, 2000.

(51) Int. Cl.[7] ..... C22B 5/00

(52) U.S. Cl. ..... 75/375; 75/382; 75/384; 75/387; 266/80

(58) Field of Search ..... 266/80; 75/375, 75/382, 384, 387

(56) References Cited

U.S. PATENT DOCUMENTS

| | | | | |
|---|---|---|---|---|
| 4,423,858 A | | 1/1984 | Ostlund | |
| 4,835,701 A | * | 5/1989 | Ohiwa et al. | 266/82 |
| 5,358,550 A | | 10/1994 | Rossborough | |
| 5,379,764 A | | 1/1995 | Barnes et al. | |
| 5,877,954 A | | 3/1999 | Klimasauskas et al. | 364/149 |
| 6,015,448 A | | 1/2000 | Kaiser et al. | |
| 6,110,109 A | | 8/2000 | Hu et al. | |
| 2001/0025232 A1 | | 9/2001 | Klimasauskas et al. | 703/13 |

FOREIGN PATENT DOCUMENTS

| | | |
|---|---|---|
| EP | 0545379 | 9/1993 |
| JP | 06073414 | 3/1994 |
| JP | 08269518 | 10/1996 |

OTHER PUBLICATIONS

Missing Data methods in PCA and PLS: Score calculations with incomplete observations, Philip R.C. Nelson, Paul A. Taylor, John F. MacGregor, Department of Chemical Engineering, McMaster University, Hamilton, ON, Canada L8S 4L8, Received Jun. 8, 1995; revised Nov. 27, 1995; accepted Jan. 11, 1996.

Improved PLS Algorithms, Bhupinder S. Dayal and John F. MacGregor, Department of Chemical Engineering, McMaster University, Hamilton, ON, L8S 4L7, Canada, Journal of Chemometrics, vol. 11, 73–85 (1997).

McGregor, JF et al: "Statisical Process Control of Multivariate Processes" Control Engineering Practice, Pergamon Press, Oxford. GB vol. 3, No. 3, Mar. 1995, pp. 403–414, XP000912180 Issn: 0967–0661.

Burnham, AJ et al. "Latent Variable Multivariate Regression Modeling" Chemometrics and Intelligent Labratory Systems, Elsevier Science Publishers, Amsterdam, NL vol. 48, No. 2 Aug. 2, 1999, pp. 167–180, XP00171919 Issn: 0169–7439.

* cited by examiner

*Primary Examiner*—Melvyn Andrews
(74) *Attorney, Agent, or Firm*—Ingrid E. Schmidt

(57) ABSTRACT

A method and computer program for determining the amounts of desulphurizing reagents required to reduce the sulphur content in hot metal to meet a specified aim concentration. The determination of the amounts of reagents is based on a multivariate statistical model of the process. This model is initially based on a set of representative data from the process including all process parameters for which data are available. These parameters include chemistry-type variables and variables representing the state of operation of the desulphurization process. The use of a plurality of process and chemistry variables provides a more advantageous determination of the reagent quantities. Also, the method includes an adaptation scheme whereby new data are used to automatically update the predictive model so that the optimality of the model is maintained. Other features of the system include optimal handling of missing data, and data and model validation schemes.

27 Claims, 3 Drawing Sheets

DESULPHURIZATION REAGENT CONTROL METHOD AND SYSTEM

This application claims the benefit of Provisional Application No. 60/224,344, filed Aug. 11, 2000.

FIELD OF THE INVENTION

This invention relates to a method of determining the amounts of desulphurizing reagents required to reduce the sulphur content in hot metal to meet a specified aim concentration. This method provides tighter control of the process resulting in less reagent usage, higher product yield, and reduced waste material.

BACKGROUND OF THE INVENTION

Hot metal desulphurization, in the iron and steel industry, is the process of adding reactive material to hot metal, mainly molten pig iron, for the purpose of controlling the sulphur content of the product. There are a variety of vessels used to contain the hot metal including specialized rail cars and transfer ladles. The reactive material is typically in a powdered form and is injected into the vessel using a lance. The reagent materials vary in composition but typically have an affinity to form chemical bonds with the sulphur in the molten metal to generate a compound that rises to the top of the vessel. Examples of typical reagents include calcium carbide, magnesium and lime. The addition of reactive material creates a sulphur rich slag layer that can be physically separated from the molten metal that now contains less sulphur.

The amount of sulphur in steel affects the quality of the steel; generally, the more sulphur in the final steel product, the lower the quality. The desulphurization process, in the steel industry, is the process whereby sulphur is removed from the molten metal so that the final steel product will have a sulphur content less than or equal to the maximum sulphur specification for the desired grade/classification of product. For any given grade/classification of product, it is acceptable to have a much lower sulphur content than the maximum specification, but it is not acceptable to have a higher sulphur content. It is important, then, to be able to determine how much reagent will be required to achieve the desired sulphur level predictably and reliably.

Control systems and models exist to determine the amount of reagent to be added. Presently in the Iron and Steel Industry, models for desulphurization use a limited set of process variables. These typically include start sulphur, aim sulphur, temperature and weight of hot metal in the vessel. These systems vary in degrees of automation but typically have automated dispensing equipment for the reagent.

There are no desulphurization reagent prediction or determination systems described in the patent literature. This is because the prior art in this area is quite simplistic and often is manifested in the form of a "hit chart", which is a table of values for the amounts of reagents required based on the starting sulphur value, the targeted final sulphur value and the weight of hot metal to be desulphurized. These simple tables are often provided by the reagent suppliers and are formulated using simple least squares regression. More sophisticated, automated systems for optimizing reagent determination, of a type similar to the invention described here, have not been documented in the patent or academic literature. The sophistication of the current reagent prediction system improves the precision of the reagent determination, which results in a tighter clustering of the final sulphur values about the targeted values. Based on the prior art, it was often the case that more reagent than necessary would be added to a batch of hot metal in order to guarantee that a majority of the time the maximum allowable final sulphur levels would not be violated. The invention improves the model precision, thereby avoiding the need to add too much reagent to the batch of hot metal. This is advantageous in that savings are realized in reduced reagent costs and also in terms of improved iron yield.

The applicant is aware of prior art in the use of multivariate statistical modeling for the determination and/or prediction of important quantities in other fields. For example, Hu and Root used a multivariate modeling approach to predict a person's disease status using a plurality of disease prediction factors, as described in U.S. Pat. No. 6,110,109. Also, a multivariate prediction equation was used by Barnes et al to determine analyte concentrations in the bodies of mammals as described in U.S. Pat. No. 5,379,764.

The prior art in the area of desulphurization is primarily related to the nature of the reagents themselves, the physical and mechanical apparatus used in the process, and the step-wise procedure for delivering the reagents. An example of prior art in the area of desulphurization reagents is U.S. Pat. No. 5,358,550. An example of prior art in the area of desulphurization physical apparatus is U.S. Pat. No. 4,423,858. An example of prior art in the area step-wise procedures for delivering desulphurization reagents is U.S. Pat. No. 6,015,448. Systems for the determination of the amounts of reagents have not been addressed to date.

SUMMARY OF THE INVENTION

The invention is an on-line system for the determination of reagent usage in hot metal desulphurization processes based on the use of a multivariate statistical model of the type "Projection to Latent Structures" (also known as "Partial Least Squares", and PLS). The model predicts the amounts of reagents required to control the sulphur content in the hot metal. Additional aspects of the invention deal specifically with on-line system implementation and model adaptation not found in the prior art.

In accordance with the invention, the model uses an extended set of input data beyond the standard sulphur concentrations, including the concentrations of key elements in the hot metal, such as silicon, manganese, and others to determine the appropriate amounts of reagents. The use of the PLS modeling methodology allows all relevant input variables to be included, even if they are highly correlated. The prior art based on least squares regression could not handle correlated inputs and is therefore restricted to a small set of input parameters.

The model output is a set of setpoints, one for each reagent, which are sent to the reagent delivery system that ensures that the specified amounts are injected.

In addition, the invention contains an adaptive component to continuously update the PLS model parameters based on new data records. This allows the model to compensate for shifts and drifts in the process. Furthermore, the invention contains a component to handle missing data in a way that allows reliable predictions to be obtained even when one or more input values are unavailable.

The invention includes the following aspects that arise solely in the case of on-line implementation;

- input data validation combined with missing data handling;
- post-desulphurization data validation prior to model adaptation;

model adaptation, model validation and updating of the missing data replacement scheme.

It is the application of this modeling technology in its adaptive form to this particular process, along with the use of an extended set of process data as inputs, that is both novel and non-obvious.

BRIEF DESCRIPTION OF THE DRAWINGS

In order to better understand the invention, a preferred embodiment is described below with reference to the accompanying drawings, in which.

DETAILED DESCRIPTION OF THE INVENTION

The invention is an on-line automatic system for determining reagent quantities for hot metal desulphurization. This system is implemented on a computer and uses an adaptive multivariate PLS model to estimate the amount of desulphurization reagent required to meet the targeted sulphur concentration. This system works for various process arrangements and is not limited by the type of vessel used to transport the hot metal (ie. the system can be used with a refractory lined ladle, a refractory lined rail car, etc.).

Figure 2:
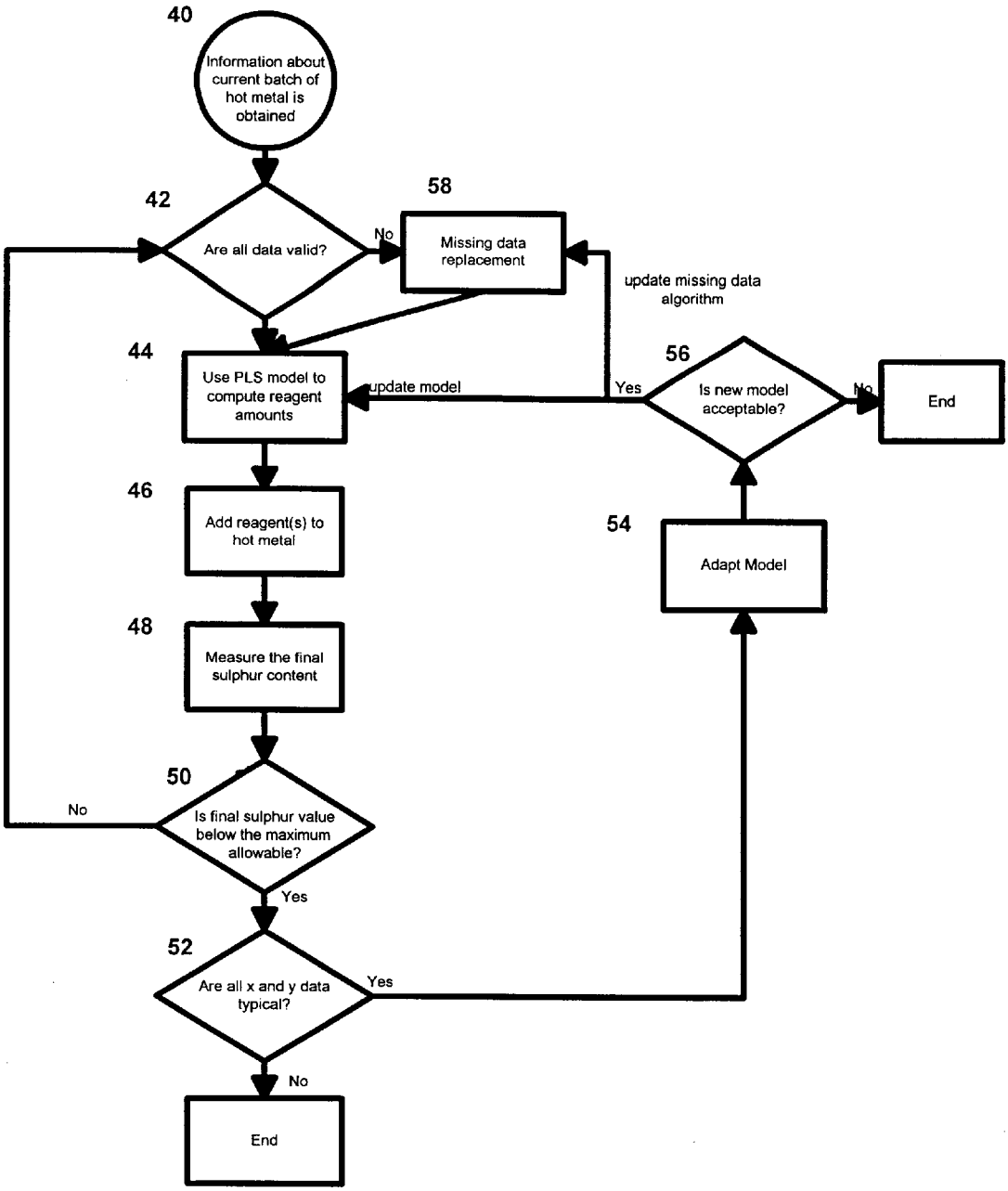
FIG. 2 is a flowchart depicting the application of an adaptive multivariate modeling methodology to the on-line determination of reagent quantities for the desulphurization of hot metal.
Figure 3:
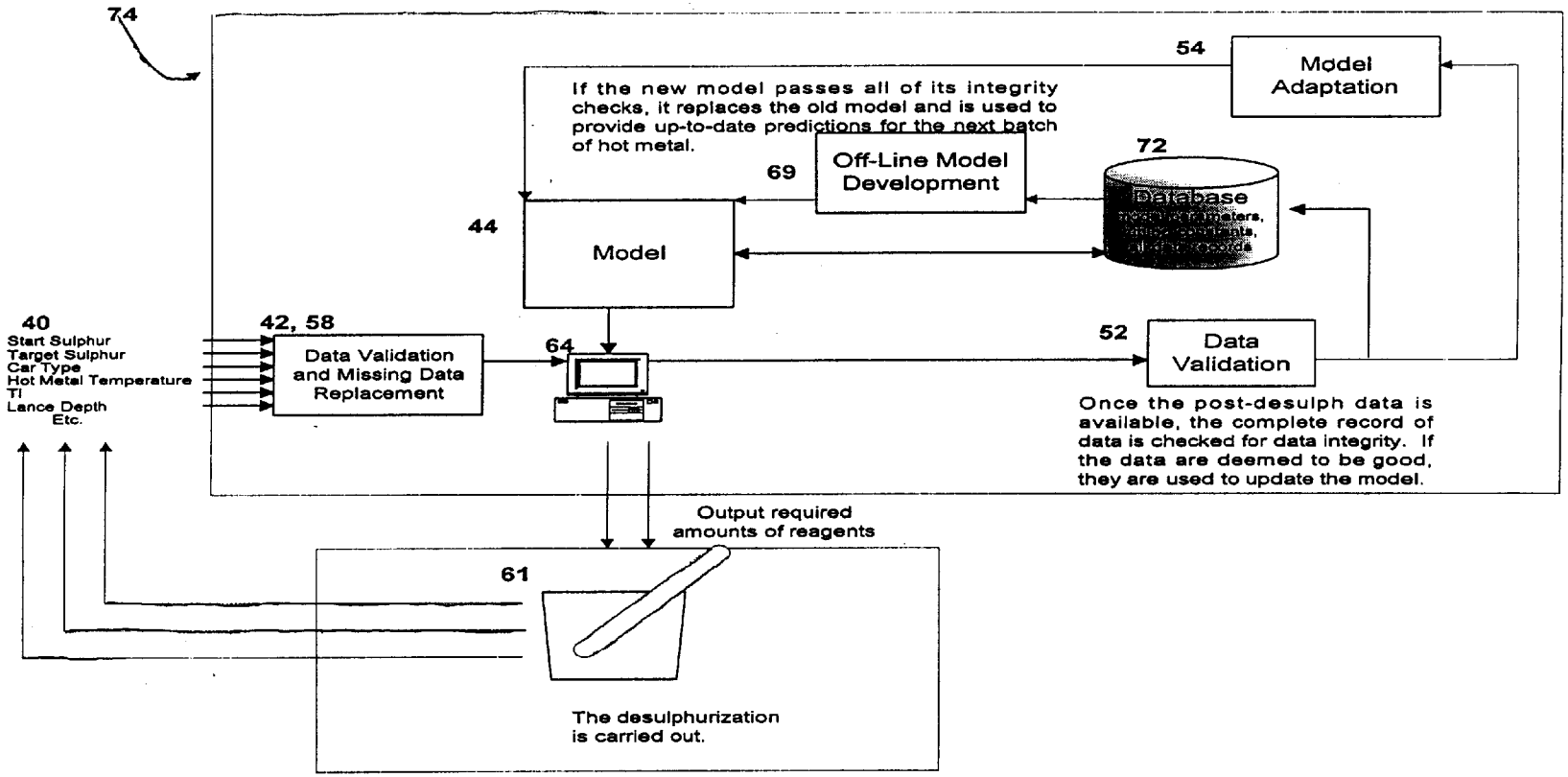
FIG. 3 is a schematic showing the basic components of an on-line system, in accordance with the invention.

An example of such a system is shown in FIG. 3. The system is initiated with an off-line model whose development is identified by reference numeral 69 in FIG. 3 and which is collectively shown in FIG. 1. The implementation process is shown in FIG. 2 and includes on-line model adaptation and missing data replacement. As described below, there are a number of aspects to the invention that impact on its successful realization.

Variable Selection

Figure 1:
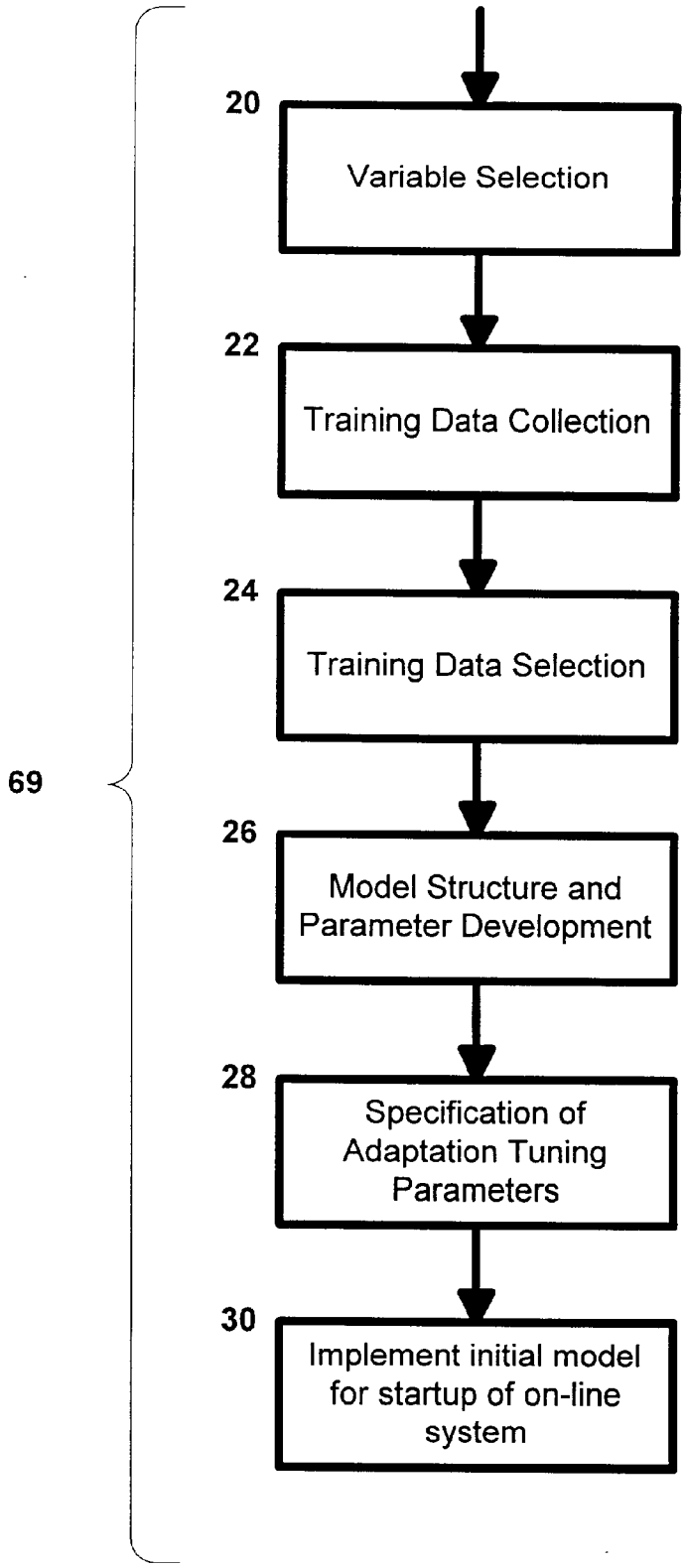
FIG. 1 is a flowchart depicting off-line model development of a multivariate model based on historical training data.

Selection of the process parameters to be used in the model as inputs in process step 20 of FIG. 1 is based on understanding the desulphurization process. A model was developed at Dofasco Inc. using the following variables:

initial sulphur concentration;

targeted final sulphur concentration;

silicon concentration;

manganese concentration;

titanium concentration;

phosphorus concentration;

weight of hot metal;

freeboard (unused capacity of vessel);

type of vessel;

final sulphur category.

Other parameters describing the state of the process, mode of operation or the nature of the hot metal may also be considered, if available, since the advantages derived from this invention are gained, in part, by using as much information as possible to determine reagent quantities. Examples of other variables that could be useful are:

carbon concentration of hot metal;

temperature of hot metal;

lance angle;

lance depth;

crew identification (team of personnel); and injection rate.

Also, any parameters associated with the desulphurization reagents themselves could also be included in the model. For example, if measurements of particle size for the reagents were available, particle size could be included as a variable in the model. This would help to accommodate for physical and chemical differences between different sources of desulphurization reagent. Including such variables could help to avoid the need for different models for each different source of reagent. In the embodiment of the invention described here, parameters associated with the desulphurization reagents are not included in the model because measurements for these are not available. Changes in the physical or chemical properties of the reagents over time are accounted for through model adaptation as described in greater detail below.

Furthermore, calculated variables may also be included in the model. For example, if the ratio of two measured variables is believed to define an aspect of the desulphurization process, then this calculated variable should be included. Similarly, any mathematical functions of one or more variables are also allowable. For example, the desulphurization model uses the logarithmic transformation of most of the process parameters.

Values for all of the variables included in the model as input variables, whether they be directly measured or calculated, must be available prior to reagent injection, or at least prior to the completion of reagent addition.

Availability of sensing equipment and automation infrastructure varies between desulphurization facilities. As a minimum requirement, a number of essential signals must be available to the system. These essential signals are:

initial sulphur value;

targeted final sulphur value;

weight of hot metal.

The use of additional signals adds to the quality ofthe model and improves the ability of the process to achieve the desired sulphur levels.

Selection of the Training Data Set

Careful off-line data collection in process step 22 and pre-processing in process step 24 to create a training data set are required for the development of an initial model. For each model, a set of data representing the entire region of normal operation must be assembled. For example, if the model is to be used for more than one target sulphur value, the training data set must include data having final sulphur values spanning the range of target sulphur values for which the model is to be used. Similarly, if one model is to be used to predict reagent quantities for more than one source of reagent, then the training data set should include a sufficient amount of data from each source for which the model is to be used. Indeed, the training data set should be inspected to ensure that the data covers the entire range of values expected to be encountered for each of the input variables.

When inspecting the data, all atypical data records should be removed from the data set.

Model Development

Prior to system implementation, an initial model is determined in process step 26 based on a set of historical data that represents the entire range of normal process operation. This process is represented in FIG. 1.

In the model development phase, the actual sulphur concentration after desulphurization is used as an input variable. During prediction, the targeted final sulphur concentration is substituted in its place to provide an estimate of the reagent required.

One of the key factors in developing the model is the conditioning of the inputs. Logarithmic transforms are used to linearize variables with hard lower bounds, such as chemical concentrations as listed above. The transformed data are then mean-centred and scaled to unit variance.

To develop a PLS model, a data matrix, X, and an output matrix, Y, are constructed with each row in X and Y containing an observation, i.e., values of the process variables and amounts of reagents, respectively, for the same vessel of hot metal. Each column of X and Y is mean-centred and scaled to unit variance.

The PLS algorithm called the Modified Kernel Algorithm, as described in Dayal and MacGregor in the Journal of Chemometrics, volume 85, 1997 the disclosure of which is herein incorporated by reference, uses the matrices $X^TX$ and $X^TY$ where T indicates the transpose of a matrix, to extract the significant predictive information in the data. The resultant model is expressed as a set of weightings that are used in the form of a prediction equation to determine the amounts of reagent required. This is the initial model that is used at start-up of the invention described here. As new data are gathered, the model adaptation module regularly updates the model parameters.

A number of models may need to be developed to cover the entire range of operation. This depends greatly on the process itself and if there are a number of distinct modes of operation, each of which requiring a separate model. Typical factors that influence the number of models required include, but are not limited to, the use of several reagent sources, the use of different containment vessels, and the use of different sets of operating practices such as injection rates.

In a specific case at the Desulphurization Station on the premises of Dofasco Inc., Hamilton, Ontario, Canada, four models are required; two different models for each of two reagent sources. For each reagent source, there is a model for use when the targeted final sulphur levels are considered high, and a model for use when the targeted final sulphur levels are considered low. The need for different models for different ranges of targeted sulphur values is based on the fact that the chemistry and behaviour ofthe desulphurization process is markedly different in the two regions, and therefore, two different models are required to capture the unique behaviour of the regions. Different models are used depending on the reagent source because it is known that there are differences in the behaviours of the reagents obtained from different sources.

Model selection in the on-line system is done automatically based on the targeted sulphur value.

Models that are used to predict reagent quantities for more than one targeted sulphur level can include indicator variables to help address any nonlinearities in behaviour between the target sulphur groups. These indicator variables can assume values of zero or one. There is an indicator variable for each different target sulphur level or class of target sulphur levels. For example, if there are two target sulphur levels, one indicator variable can be used. This variable will assume a value of zero when the target sulphur level is low, and will assume a value of one when it is high. These types of indicator variables can also be used to represent states of the process, for example, to indicate the type of vessel being used, or the crew (team of personnel) that is working. These indicator variables can appear in the model as terms on their own or as multipliers with other variables.

The use of indicator variables allows qualitative or state-type variables to be included in the model. For example, indicator variables are used at Dofasco Inc. to represent the type kind of vessel in use. They can also help to take account of nonlinearities between different regions of data. For example, at Dofasco Inc., the indicator variables representing groups of target final sulphur values help to take account of nonlinearities between the behaviours of the reagents at different sulphur levels.

Selecting the Number of Significant Components

As part of the model development activity, the selection of the number of significant components in the PLS model determines the performance of the system. The objective in selecting the number of components is to maximize the information content of the model with the fewest number of components. The number of significant components is determined by the training data based on the method of cross-validation. At Dofasco Inc., a choice was made to limit the number of principal components to three. This was based on the fact that after three, the additional principal components did not significantly add to the predictive ability of the model.

Determining Values for the Data Discounting Factors

The data discounting factor, $\alpha$, is specified in process step 28 in FIG. 1 and used in process step 54 of FIG. 2, as part of the model adaptation scheme, is determined based on the desired rate of adaptation. This factor determines how much influence new data have on the updating of the model. In the current embodiment of the invention at Dofasco Inc., the value of $\alpha$ is 0.9. This means that the new data have a relatively small influence on the model and that the adaptation occurs relatively slowly. The choice of a value for $\alpha$ is also dependent on the time interval between model adaptations, and the number of new data records used for each adaptation. The rate at which the model should adapt should be based on the rate at which the process is expected to shift or drift in a significant way.

On-Line System Implementation

Once the initial models are developed off-line, on-line implementation of the prediction system in process step 30 of FIG. 1 is required and contains inventive steps in how to automatically update the model through an adaptation scheme, and how to handle missing data in order to achieve the desired results.

The system that controls the reagent addition injects the appropriate amounts of reagents based on the outputs of the model developed above and is generally identified by reference numeral 74 in FIG. 3. The model component of the system 74 is implemented on a computer 64 that has access to input data 40, either through manual input or computer network link to another computer where the data reside. The output 44 of the model, the amount of reagent to be used, is presented to an operator on a video monitor 64 and can be passed to an automated reagent delivery system via operator entry or electronic communication link to a hot metal vessel 61. The results of the desulphurization activity (i.e. the measured final sulphur content of the hot metal) must be made available to this computer 64 to enable the adaptive component of the system 74 to update the model parameters for subsequent predictions.

FIG. 2 shows the sequence of events involved in the on-line desulphurization control system.

A more detailed description of the various steps in the control process is given in the sections below.

The input data for the current batch of hot metal data 40 is obtained by the system computer 64 either through manual entry from the operator or directly from process sensors or other databases. The computer 64 has computational devices configured to calculate the outputs 44 of the model based on the input data 40. Further computations are done to check the validity of the data prior to desulphurization and after desulphurization. Computations are involved in missing data replacement step 58 and in model adaptation step 54.

The normal sequence of events related to the operation of the reagent control system 74 is as follows. A new batch of hot metal is ready to be desulphurized. The prediction system computer 64 obtains values for the input variables 40 directly from electronic sources or from manual operator entry. These input values are validated at process step 42 to determine if any of the values are missing or considered unreliable. Any values that are missing or are unreliable are replaced with estimated values that are determined by the missing data replacement step 58.

The complete and validated input data are then substituted into the PLS model at process step 44 and values for the amounts of the reagents required are displayed on a video monitor 64 to the operator. These quantities of reagents are automatically injected into the batch in process step 46 once the operator has confirmed the amounts.

When the desulphurization is complete, a sample is taken from the hot metal vessel 61 and the sulphur concentration is measured at process step 48. This is the final sulphur concentration. An evaluation is made in process step 50 on whether the final sulphur data meet process criteria. If the final sulphur concentration is greater than the maximum allowable sulphur level for the desired grade of steel, then the batch must undergo a second injection of reagent. If the final sulphur concentration is less than or equal to the maximum allowable, then the hot metal is sent to steelmaking for further processing, and the complete data set including all of the input values, the amounts of reagents added, and the final sulphur values, is validated in process step 52 to ensure that this data point represents typical operation. If it does, the data are stored in database 72 (FIG. 3) and used to update the model in process step 54. The model is updated using at least 100 valid data records, once every day. The new model obtained after adaptation is checked in process step 56 to make sure that it is not substantially different from the previous model. If it is not too different, the new model replaces the existing model and the missing data replacement scheme 58 is updated based on the information from the new model.

As indicated, there are a number of features that are novel and non-obvious in the realization of such a system. These features are described in more detail in the text below.

Input Data Pre-Processing

All of the input data are checked to make sure that their values fall within their respective acceptable ranges. If they do not, the value is considered "missing". Next, the data are pre-processed, which typically includes making a logarithmic transformation, centering each variable around zero and scaling to unit variance.

Missing or Invalid Input Data Compensation

One of the features developed for the on-line system is the ability to continue operation in the absence of a complete set of input data. On occasion, input data are invalid due to communication errors or errors in manual entry. The system can flag the input as "missing"in process step 42 and work with the balance of the inputs to provide a prediction. This is done by estimating values for missing variables 58. The algorithm used is called Conditional Mean Replacement, which is described by Nelson et al in Chemometrics and Intelligent Laboratory Systems, volume 35, 1996 the disclosure of which is herein incorporated by reference. The algorithm relies on correlation information contained in the $X^TX$ matrix to compute estimates for all of the missing values. These estimates are then used in place of the missing data and the PLS model is used in the normal way. This can be done for any of the inputs other than start and aim sulphur concentrations, which are considered critical.

This feature adds greatly to the robustness of the invention.

Model Scheduling

As discussed above, more than one model 44 may be required to cover the entire range of operation. The model to be used at any given time is determined automatically based on the source of the reagent and the targeted final sulphur value. This ensures that the model used to predict the amount of reagent required is consistent with the one developed based on data representing similar conditions.

Model Adaptation

To accommodate for shifts and drifts in the process, a methodology for automatically and regularly updating the model is an important part of the invention. This is called model adaptation and is embodied in process step 54 of FIG. 2.

The adaptation scheme is a modified version of one proposed by Dayal and MacGregor in the Journal of Chemometrics, volume 11, 1997 the disclosure of which is herein incorporated by reference. At regular time intervals, a set of new observations is queried from the database. This new data is represented by the matrices $Y_{new}$ and $X_{new}$. The covariance structure of the new data is computed as follows.

$$(X^TX)_{new} = \frac{1}{n_{new}-1} X_{new}^T X_{new}$$

$$(X^TY)_{new} = \frac{1}{n_{new}-1} X_{new}^T Y_{new}$$

where $n_{new}$ is the number of observations in the new X and Y matrices.

These matrices are used to update the "old" covariance structures. This updating is done using a standard moving average scheme as follows.

$$(X^TX)_{updated} = \alpha(X^TX)_{current} + (1-\alpha)(X^TX)_{new}$$

$$(X^TY)_{updated} = \alpha(X^TY)_{current} + (1-\alpha)(X^TY)_{new}$$

The means and variances used to mean centre and scale the variables are also updated using a standard moving average scheme. The updated correlation matrices are then used to fit a new PLS model. Note that for the very first iteration of the adaptation loop the "current" matrices are computed using the original data sets as follows.

$$(X^TX)_{current} = \frac{1}{n_{original}-1} X_{original}^T X_{original}$$

Tuning parameters define how often the model 44 is updated and how much data is used to update the model, along with the value of the discounting parameter, $\alpha$. For Dofasco Inc.'s Desulphurization Facility, the models are updated once per day, using 100 valid data records with a value for $\alpha$ of 0.9. Provisions are made so that the data set used for updating spans the range of final sulphur values that the model is meant to represent.

The algorithm used is advantageous in that it requires only that the matrices $X^TX$ and $X^TY$ be stored from iteration to iteration. These matrices require much less computer storage space than the actual data matrices would.

Prior to model adaptation 54, the complete data set including the final sulphur value and the amounts of reagents added, is validated. This validation is done by comparing the predicted reagent quantities, using the observed final sulphur value, to the actual reagent quantities used. If there is a large difference between the predictions and the actual amounts, then the data are considered invalid and are not used for adaptation.

Model Validation

Once the updated model coefficients have been obtained, they are passed through a series of checks and validations before being implemented in process step 56. This ensures that the model will not change drastically from one observation to the next, and also serves to catch invalid data that was missed by the earlier checks. If the new model passes all of the checks then it replaces the previous model 44 and is used to determine the required reagent amounts for the subsequent vessel 61 of hot metal.

There are three checks that are performed. The first check is done to make sure that the magnitude of the change in all of the model parameters is not too great. The second check ensures that the magnitude of a change in any one single model parameter is not too great. The third check ensures that the predicted amounts of reagents, based on the new model, are not too different from the actual reagent quantities used.

The realization of a desulphurization reagent determination system using a multivariate model of the process requires the availability of the process measurements described above to a computer. The computer is used to calculate model outputs to dictate the amounts of reagent required to adequately desulphurize abatch of hot metal. The reagent may comprise a mix of any one of calcium carbide, magnesium and lime. A realization of said system is currently in operation at Dofasco Inc.

Initial model development is done off-line using historical data. Model adaptation tuning parameters are also determined during this development.

It will be understood that several variants may be made to the above-described embodiment of the invention, within the scope of the appended claims. Those skilled in the art will appreciate that multivariate statistical models other than Partial Least Squares (PLS) may be suitable for such applications and could also provide reliable predictions for the amounts of reagents required.

What is claimed is:

1. A method for determining the amounts of reagents required in the desulphurization of a hot metal batch, the method including the following steps:

a) acquiring historical values of process parameters;

b) selecting training data from said historical values of process parameters to represent normal operation of a desulphurization station;

c) developing a multivariate statistical model corresponding to normal operation of the desulphurization station with input from said training data;

d) acquiring on-line values of process parameters during operation of the desulphurization station; and e) calculating an output vector to predict required amounts of desulphurization reagents using said multivariate statistical model, and updating said multivariate statistical model over a predetermined period of operation by;

f) acquiring a set of recent complete data records including measured amounts of desulphurization reagents added to hot metal and measured final sulphur contents in hot metal over said predetermined period of operation;

g) selecting said data records that represent typical operation;

h) creating an updated multivariate statistical model based on the said selected data records using a model adaption scheme;

i) comparing said updated multivariate statistical model to the existing multivariate statistical model to determine whether the models are consistent and any changes in the updated multivariate statistical model are small; and j) replacing the existing multivariate statistical model with said updated multivariate statistical model if the updated multivariate statistical model is consistent with the model it is replacing.

2. Method according to claim 1 in which the multivariate statistical model is a Partial Least Squares (PLS) model.

3. Method according to claim 1 in which said step c) is performed using the Modified Kernel Algorithm for PLS modeling.

4. Method according to claim 1 in which said multivariate statistical model is based on n principal components, the number n being determined using the method of cross-validation.

5. Method according to claim 1 in which said process parameters include starting sulphur concentration, targeted sulphur concentration and weight of hot metal in the hot metal batch.

6. Method according to claim 5 in which said process parameters include any other process parameters for which values are available, including parameters selected from the following group: silicon concentration, titanium concentration, manganese concentration, phosphorus concentration, freeboard, hot metal temperature, carbon concentration, lance angle, lance depth and injection rate of the hot metal batch.

7. Method according to claim 5 in which said process parameters may also include indicator variables used to represent qualitative variables selected from the following group: kind of vessel, desulphurization reagent source, and crew identification.

8. Method according to claim 5 in which said process parameters include indicator variables used to account for process nonlinearities by representing regions of distinct operation based on groupings of process parameters.

9. Method according to claim 8 in which said groupings include groups of target final sulphur values.

10. Method according to claim 1 in which at least one of said process parameters is mathematically transformed.

11. Method according to claim 10 in which at least one of said process parameters is mathematically transformed using a logarithmic transformation.

12. Method according to claim 2 in which said step c) involves reagent quantities that are mathematically transformed prior to use in the PLS algorithm.

13. Method according to claim 12 in which said reagent quantities are mathematically transformed using a logarithmic transformation.

14. Method according to claim 1 in which said historical values of process parameters are categorized into typical and atypical classifications and a training data set is selected from said values taken from the typical classification.

15. Method according to claim 1 in which said training data includes a range of start sulphur concentrations and final sulphur concentrations which typify normal operation.

16. Method according to claim 1 in which respective multivariate statistical models are developed from respective training data sets, each corresponding to normal operation of a desulphurization station for a pre-defined range of data.

17. Method according to claim 16 in which said predefined range of data is selected from ranges for targeted final sulphur values, desulphurization reagent source and kind of vessel.

18. Method according to claim 1 in which the required amounts of desulphurization reagents are graphically displayed to an operator for confirmation.

19. Method according to claim 1 in which the required amounts of desulphurization reagents are transmitted electronically to a reagent injection system.

20. Method according to claim 1 in which said data records are selected for use in the model adaptation scheme according to a calculated difference between amounts of desulphutization reagents added to the hot metal batch and the amounts of desulphurization reagents predicted based on the multivariate statistical model and a measured final sulphur content in the hot metal batch.

21. Method according to claim 1 in which said model adaptation scheme is the Modified Adaptive Kernel Algorithm.

22. Method according to claim 1 in which a value for a discounting factor $\alpha$ is selected for use in the model adaptation scheme in accordance with a rate at which a desulphurization process is expected to drift.

23. Method according to claim 1 in which said updated multivariate statistical model and said existing multivariate statistical model are compared in step (i) based on the vector distance between the updated model parameters and the existing model parameters.

24. Method according to claim 1 in which said updated multivariate statistical model and said existing multivariate statistical model are compared in step (i) based on the largest change in any one parameter.

25. Method according to claim 1 in which said updated multivariate statistical model and said existing multivariate statistical model are compared in step (i) based on the vector distance between the amounts of reagents predicted based on the updated multivariate statistical model and the amounts of desulphurization reagents added to the batch of hot metal.

26. Method according to claim 1 including the following steps:

k) determining whether said on-line values of process parameters are consistent with acceptable ranges for the parameters and flagging those that are missing or invalid;

l) using a missing data replacement scheme to estimate values for the said missing or invalid values; and m) replacing the said missing or invalid values with the said estimated values.

27. Method according to claim 26 in which said missing data replacement scheme is the Conditional Mean Replacement algorithm.

* * * * *